US005141111A

United States Patent [19]

Licht

[11] Patent Number: 5,141,111

[45] Date of Patent: Aug. 25, 1992

[54] SYSTEM AND METHOD FOR INSPECTING AND REJECTING DEFECTIVE CONTAINERS

[75] Inventor: Thomas A. Licht, Boulder, Colo.

[73] Assignee: Ball Corporation, Muncie, Ind.

[21] Appl. No.: 601,975

[22] Filed: Oct. 22, 1990

[51] Int. Cl.[5] ..... B07C 5/342; B07C 5/36

[52] U.S. Cl. ..... 209/558; 209/564; 209/577; 209/653; 209/587

[58] Field of Search ..... 209/552, 555, 556, 558, 209/563-565, 576, 577, 586, 587, 597, 598, 651, 653; 250/341, 358.1, 359.1, 360.1

[56] References Cited

U.S. PATENT DOCUMENTS

| | | | |
|---|---|---|---|
| 2,987,179 | 6/1961 | Allgeyer et al. | 209/653 X |
| 4,029,958 | 6/1977 | Wright | 209/587 X |
| 4,385,699 | 5/1983 | Ashina | 209/558 X |
| 4,386,708 | 6/1983 | Sieverin | 209/644 X |

FOREIGN PATENT DOCUMENTS

| | | | |
|---|---|---|---|
| 0047612 | 3/1982 | European Pat. Off. | 209/579 |

*Primary Examiner*—Michael S. Huppert
*Assistant Examiner*—Edward M. Wacyra
*Attorney, Agent, or Firm*—Gilbert E. Alberding

[57] ABSTRACT

A system and method for inspecting and rejecting defective containers comprising a plurality of reflective infrared sensors, an electronic logic control and a container removal device. The system assesses the quality of the flange of the container and senses the height of the container by sensors irradiating the flange portion of the container with narrow beams of infrared light at varying heights and receiving radiation reflected from the flange portion. The acceptability of the container is determined by the quantum of reflected radiation received by the sensors. Unacceptable containers are removed by a high-speed pneumatic cylinder coupled to independently controlled, solenoid-operated air valves which govern the movement of the cylinder piston of the pneumatic cylinder.

28 Claims, 4 Drawing Sheets

SYSTEM AND METHOD FOR INSPECTING AND REJECTING DEFECTIVE CONTAINERS

TECHNICAL FIELD

This invention relates to systems and methods for inspecting articles during manufacture, and more particularly, relates to a system and method for inspecting the flange portion of a container utilizing infrared reflective sensing means and for effecting the removal of unacceptable containers utilizing a fast-acting rejection device.

BACKGROUND ART

Automated inspection systems for ensuring the manufacture are well known. Systems are commonly used in processes including assembly verification, gauging, character verification and recognition, surface flaw detection, sorting systems, robotic guidance and like processes. For example, electro-optical sensing means are commonly used for detecting defects in transparent articles. In many of these applications, such systems provide inspection of 100 percent of the product.

In the metallic container manufacturing industry, the containers are transported in an empty, open-top condition during their manufacture prior to being packed. The bodies of the containers are often damaged in the open end neck or flange portion during their manufacture. In addition, containers often become dented, distorted or otherwise damaged rendering them unacceptable for further manufacture. If the container is dented or in any way damaged, it can create a jam-up in subsequent manufacturing operations, making it necessary to stop the entire production process and remove the jammed containers. Such a jamming occurrence also often results in good or acceptable containers being damaged, thereby increasing spoilage each time a jam occurs. This problem also arises where a container has been tipped or downed on the conveyor system.

An unavoidable consequence of such occurrences is the lost production time and increased spoilage. Conventional devices employed in this particular application often use mechanical means to allow defective containers to fall out of the manufacturing line. Most conventional high-speed ejection devices must eject several articles before and after a defective part to assure that the defective article is removed. Small part ejection devices usually consist of a compressed air jet or a small air cylinder ram for knocking the part from a single lane conveying device.

At increased conveying speeds and with close spacing of parts, it becomes especially difficult to eject lightweight parts. The difficulty is in a couple of areas. First, when a part is ejected rapidly, air currents are created which often displace adjacent parts. If the adjacent parts are displaced significantly, a conveying jam will occur. Second, as conveying speeds are increased, it is difficult to make the air cylinder ram extend and retract fast enough to properly eject a part and retract out of the way of the next advancing part and/or be ready to eject the next part should there be two (or more) adjacent defective parts. As noted, current practice is to eject several parts before and after the defective part to assure that the defective part is removed from the production flow. This practice generates unnecessary spoilage as good parts are sacrificed.

It has also become common to use vacuum devices in prior systems to automatically detect and reject downed cans. With devices of this type, a vacuum is normally applied to the open upper end of an upright container to hold the container against a moving conveyor while the downed cans will not be held against the vacuum mechanism and will drop down to a collection location generally below the vacuum mechanism.

One such apparatus for detecting and rejected downed and damaged containers is disclosed in U.S. Pat. No. 4,146,467 to Sauer, et al. This patent describes a transfer mechanism coupled to vacuum means wherein the vacuum holds the upper ends of the upright cans against the moving transfer mechanism so that the upright cans can be transferred from an upstream conveyor to a downstream conveyor. If the upper flange of the container is distorted in any way, possibly due to damage or denting of the sidewall of the container, the vacuum will be unable to hold the container against the transfer mechanism belt and the damaged can will be dropped from the transfer belt to a collection site located below.

There has developed a distinct need in the manufacturing industry to be able to identify and remove substantially all unacceptable articles from a continuous stream of articles being transported at high production speeds while reducing the spoilage of acceptable articles.

SUMMARY OF THE INVENTION

This invention presents an apparatus and method for inspecting the upper flange or "neck" portion of an article, for confirming the minimum acceptable height of the article and for effecting the removal of only unacceptable articles from a conveying system. The apparatus and method of the invention may be used for the inspection of any article or material that has reflective properties so that a defect in a part of the article would result in a reduction of the part's reflective properties. Moreover, the invention can also identify damage or imperfection in the decorative coating of such articles if the imperfection is significant. The invention is particularly useful with metallic containers so the following specification of the invention is made in reference to the manufacture of metallic containers. The scope of the invention is limited, however, only by the appended claims.

Generally, the invention includes a defect sensing means and an article removal means. The defect sensing means employs infrared sensors to assess the quality of the surface of the article, particularly the flange or neck portion of a container and, in conjunction with an electronic logic control, determines whether the container is of an acceptable minimum height for further manufacture. The invention identifies and removes from the conveying system containers that are too short (for example, containers that have been dented or crushed) and containers having unacceptable flanges.

The defect sensors require the articles to be transported through an inspection station in tandem order and to be held therein to a reference plane. If the sensors determine an article to be unacceptable, a rejection signal is generated to effect the removal of the unacceptable article at an ejection station.

The sensors are preferably positioned adjacent the inspection station of a conveying system and are coupled to the logic control which in turn is coupled to the removal means to eject unacceptable articles from the system. The sensors are arranged circumferentially about the inspection station so that when an article is positioned at the inspection station, the sensors irradiate the circumference of the container with beams of infrared light. If no defects exist, the infrared light will be reflected from the article and received by the sensors, thereby indicating an acceptable article. If a defect exists in the container, the sensors will receive insufficient reflected infrared light and will thus identify the container as unacceptable by generating a reject signal corresponding to that container.

The removal means of this invention comprises a fast-acting, lightweight, fluid-driven ejection cylinder arranged adjacent to the ejection station for engaging and removing unacceptable containers from the conveyor upon receiving the rejection signal. The ejection cylinder is coupled to air solenoid valves which in turn are coupled to a pressurized fluid source.

The solenoid valves are preferably of the four-way type having a high flow area, low voltage and high wattage. Two valves are preferably used so that their on/off times can be independently controlled to allow pressure to build in the opposite mode before the holding pressure is released in the current mode. This practice minimizes the capacitive effect of the piping volume between the cylinder ram and the solenoid valves.

The fluid-driven cylinder is very light in weight and is equipped with piston seals that act as shock absorbers. The cylinder comprises a non-steel, lightweight piston, and a piston rod which has a longitudinal, internal bore extending along its length. The piston may be constructed of a metallic or non-metallic material. Maximizing the cycle speed of the cylinder is achieved in part by the short air cylinder stroke.

In a preferred embodiment of the invention, the sensors comprise a circumferential array of four reflective, infrared, fiber-optic sensors. Each infrared sensor preferably includes bifurcated optics adapted to direct narrow beams of infrared light at the open end of the container and to receive reflected infrared light. Thus, the sensors inspect the structural integrity of the flange of the the container and generate an inspection signal corresponding to the quantum of infrared light which they absorb and direct the corresponding inspection signals to the electronic logic control. In addition, one or more such sensors can verify the height of the container and direct a corresponding height signal as well to the logic control. The logic control, upon receiving an unacceptable inspection signal, controls the timing of the removal means to effect the removal of the unacceptable container from the conveyor.

The defect sensing means further comprises a first container position sensor arranged adjacent the inspection zone for indicating when a container is positioned at the inspection station and for initiating the inspection sequence. Similarly, the container removal means preferably includes a second container sensor for indicating when a container is positioned at the rejection station, thereby initiating the rejection sequence. The container position sensors are preferably absorptive electro-optical detectors, commonly known as an "electric eye." When the sensors are triggered, that is, when the light beams they employ are interrupted, each generates a signal indicating the presence of a container.

The electronic logic control provided by this invention monitors the status of the defect means, tracks the unacceptable container after it leaves the inspection station and, upon receiving a container present signal from the second container position sensor, generates the rejection signal initiating the removal of the unacceptable container. The rejection signal activates the solenoid valves that admit pressurized fluid to and from the cylinder to remove the unacceptable container.

This invention thus provides a method for detecting unacceptable containers and effecting their removal from the manufacturing line. The method is carried out as described above by determining a desired height for the container and a desired structural integrity for the flange portion of the container, presenting the container to an inspection station, sensing the structural integrity of the flange portion and the height of the container, determining when the sensed information is acceptable, and rejecting the container if the sensed data is unacceptable.

Therefore, it is the object of the present invention to identify and remove from the conveying system unacceptable articles.

It is a feature of this invention to provide reflective sensors, which identify unacceptable articles by the quantum of infrared light reflected and received by the sensors, and a lightweight, high-speed ejection mechanism to remove the identified unacceptable containers.

It is thus an advantage of this invention that unacceptable articles may be identified and removed from a production stream of articles moving in tandem order at very high production speeds without jamming the conveying equipment, thereby reducing downtime, and without ejecting acceptable articles positioned adjacent to the unacceptable article, thereby reducing spoilage.

BRIEF DESCRIPTION OF THE DRAWINGS

The foregoing and other features of this invention will be more particularly described in connection with the preferred embodiment, and with reference to the detailed description set forth below and the accompanying drawings wherein.

DETAILED DESCRIPTION OF THE PREFERRED EMBODIMENT

Figure 1:
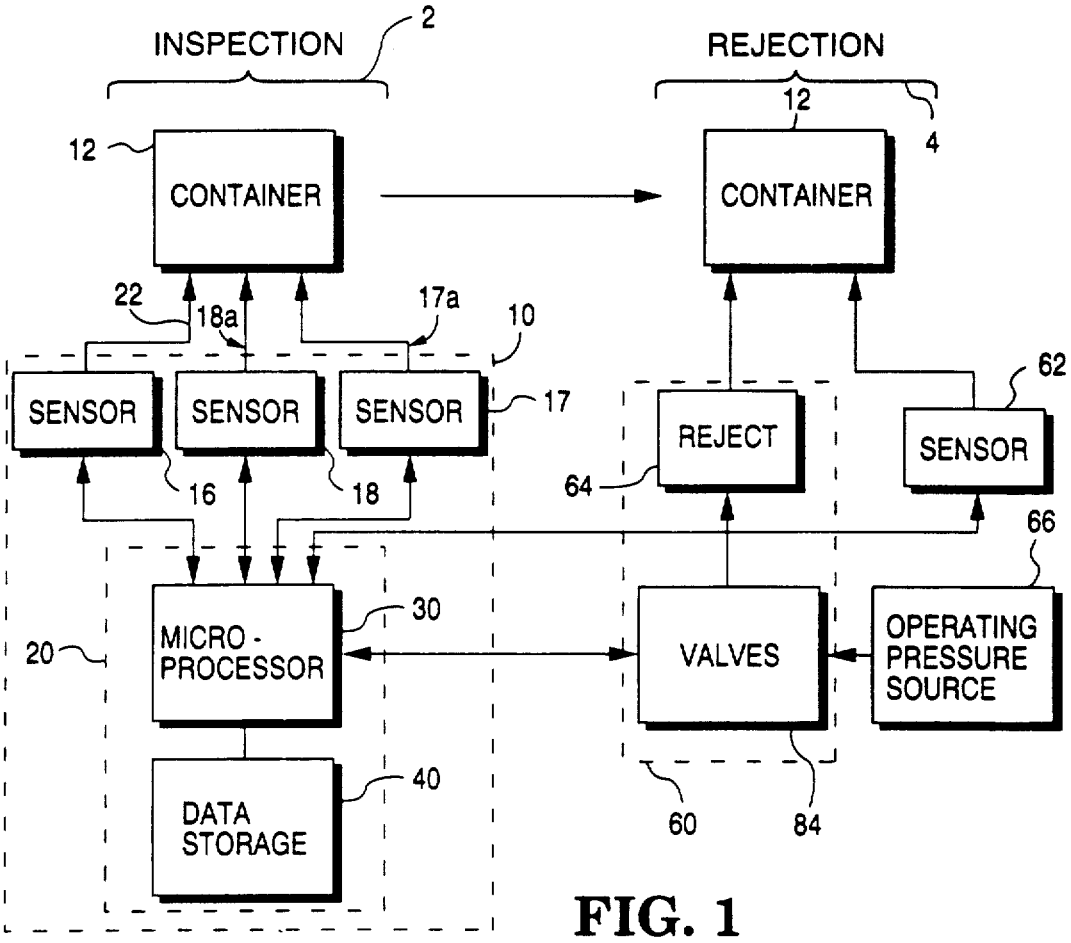
FIG. 1 is a schematic illustration of a defect sensing means and a container removal means coupled to the defect sensing means, each being provided by the invention.

A presently preferred embodiment of the apparatus and method provided by this invention is shown in FIGS. 1-8B wherein like components are designated by like reference numerals throughout the various figures. An article to be inspected by this invention preferably is a metallic container 12 generally having a cylindrical body, a pair of opposing ends, the upper end of which is normally open as manufactured and the lower end 12*b* of which is normally closed, and an upper flange or neck portion 12*a* adjacent the open upper end. However, this invention may be used to inspect any article or material having sufficient reflective properties so that a defect in a part of the article results in a reduction of the part's reflective properties.

This invention includes defect sensing means 10 arranged adjacent an inspection station or zone 2 of a conveying system 14 coupled to container removal means 60 arranged adjacent a rejection station or zone 4 of the system. Defect sensing means 10 provided by this invention and shown in FIGS. 1 and 2 generally comprises a plurality of reflective sensors 16 (shown schematically as a single sensor unit 16 in FIG. 1 for clarity), and a first container position sensor 18, each coupled to an electronic logic control 20. A container height sensor 17 may also be included, if desired.

Sensors 16 are adapted to inspect the neck and flange areas of each container by irradiating the circumference of the neck or flange portion 12*a* of container 12 with infrared radiation 22 to sense the structural integrity of the flange and to verify the height of the container. Radiation 22 emitted from sensors 16 reflects off an acceptable flange 12*a* and is received back by the sensors 16. If a defect or any other unacceptable imperfection in the neck portion exists, as illustrated by 12*c* in FIG. 2, a portion 22*a* of the radiation will not strike that section of the flange where the defect exists and will pass through the defect and not be reflected and received by the originating sensor.

Figure 2:
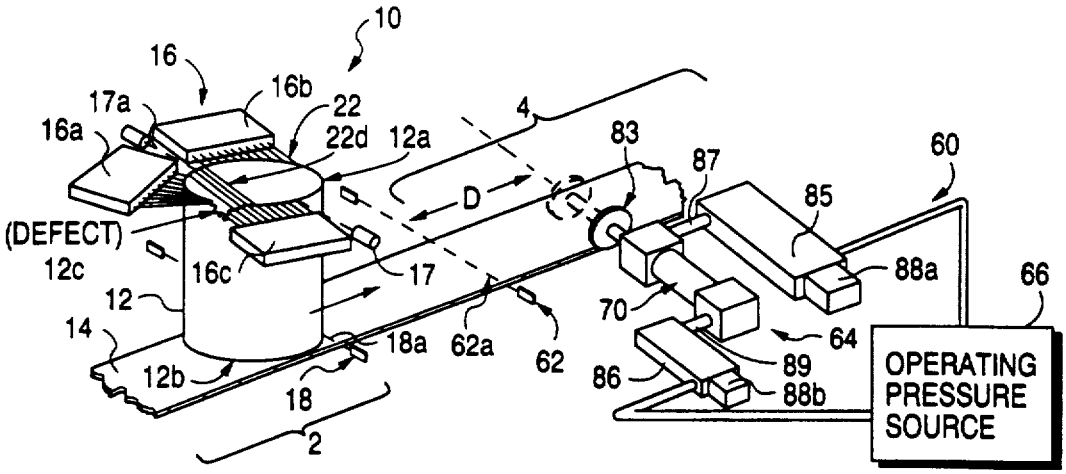
FIG. 2 is a partial schematic and perspective view of the defect sensing means and the container removal means shown in FIG. 1.
Figure 3:
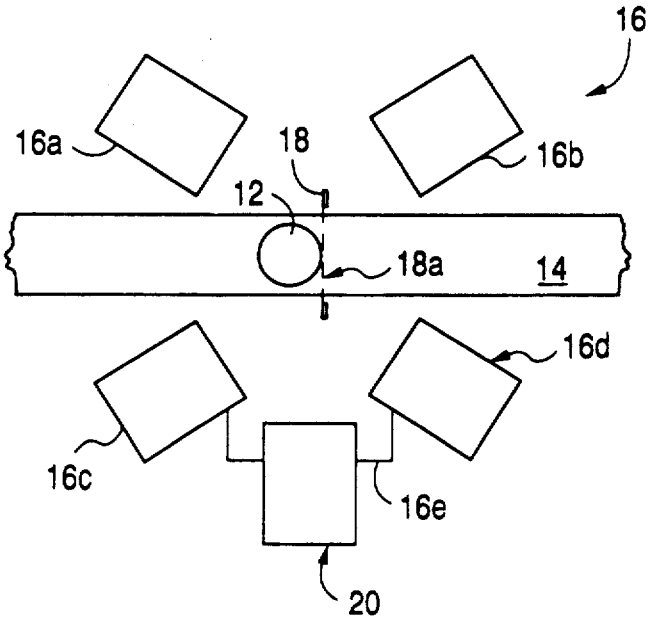
FIG. 3 is a top schematic view of the defect sensing means as shown in FIG. 2.

Sensors 16 more particularly include a plurality of individual infrared reflective sensors 16*a–d* to inspect each container as it is passed through inspection station 2. (For clarity, individual sensor 16*d* is not shown in FIG. 2, but is shown in FIG. 3.) During manufacturing, a container is normally transported by the conveying system 14 in an upright position by its base portion or closed end 12*b* so that open portion or flange 12*a* is on top. As the container 12 is carried through the inspection station or zone 2, each reflective sensor 16*a–d* is positioned to irradiate a different section of the open end portion 12*a* of the container and to receive the radiation reflected from each different section. From the quantum of radiation received by each of the reflective sensors 16*a–d*, it can be determined which containers have unacceptable open end portions 12*a*. As shown in FIGS. 2 and 3, sensors 16*a–d* are positioned in a circumferential array to irradiate different circumferential sections of the open end 12*a* of the can.

Sensors 16 are set to predetermined levels prior to any inspection sequence to generate a binary-type rejection signal varying between two states. The first state indicates that a sufficient quantum of reflected - light has been received by each of the sensors 16*a–d*, thereby indicating an acceptable container. The second state indicates that at least one of the sensors 16*a–d* received an insufficient quantum of light, that is, less than the pre-set level, thereby indicating an unacceptable container. Sensors 16 thus generate an inspection signal dependent upon the quantum of radiation received by the sensors and direct the corresponding inspection signal to the logic control 20.

In addition to inspecting the neck portion or flange area of the containers for structural integrity and acceptable coatings, each sensor 16*a–d* preferably employs bifurcated fiber optics to direct a plurality of narrow beams of infrared light across the inspection station and to receive infrared light reflected from a can located at the inspection station in such a manner as to verify container height in addition to sensing the structural integrity of the flange. For example, one of the sensors 16*a–d* can be positioned above, or oriented with respect to the reference plane, in such a manner that it can identify containers of unacceptable height.

An additional photoelectric sensor 17 may be arranged adjacent to the inspection zone 2 in the event a container or article that is too short passes through the zone. During such an occurrence, sensors 16*a–d* will have a tendency to "cross-talk," that is, each sensor will "see" the other sensors (absorb their radiation) and give a false acceptable inspection signal to the control 20. Sensor 17 is positioned adjacent the inspection zone to direct a horizontal light beam 17*a* across the inspection zone at the minimum acceptable height for a container. A can of at least minimal acceptable height passing through the inspection station will interrupt the light beam 17*a*. Conversely, when a can is not of the minimum acceptable height (too short), it will pass through the inspection zone and not interrupt light beam 17*a*, thereby indicating that the can is too short. When the control 20 receives a positive or acceptable inspection signal from sensors 16*a–d* but fails to receive a signal from sensor 17 that its light beam 17*a* has been interrupted, this indicates that the inspection signal is false and that the container is in fact unacceptable due to its height. Control 20 then identifies that container in order to subsequently effect its removal.

First container position sensor 18, defined by a photoelectric eye, indicates when a container is properly positioned at the inspection station 2. When sensor 18 senses the proper position of a container at the inspection zone 2, it initiates the inspection sequence by directing a first container present signal to the control 20. Similarly, can removal means 60 preferably includes a second container position sensor 62 for providing a signal when a container is properly positioned at the rejection station 4, thereby initiating the rejection sequence.

Container positioning sensors 18 and 62 preferably each comprise electro-optical detectors comprising a light-projecting means and a photosensitive receiving means. The light-projecting means is adapted to direct a beam of light at the photosensitive receiving means whereupon the receiving means generates and directs a container present signal to the control 20 upon the interruption of the respective light beams by the container.

Logic control 20 tracks an unacceptable can as it is transported by the conveyor 14 until the container reaches the rejection station 4, and when the tracked container interrupts the light beam of second container position sensor means 62, it initiates the reject cycle. Logic control 20 preferably comprises an electronic circuit/programmer or an electronic data processor 30 coupled to data storage means 40 as shown in FIG. 1. However, it should be noted that, if desired, the logic functions of defect sensing means 10 may be implemented by discreet, hard-wired components and logic circuits.

Sensors 16 defined by the circumferential array of infrared reflective sensors 16*a–d* are further shown in the top schematic view in FIG. 3 in which sensors 16*a* and 16*d* are arranged generally on opposite sides of the container; and sensors 16*b* and 16*c* are likewise arranged generally on opposite sides of the container 12. First container position sensor 18 is arranged adjacent the inspection zone so that when the container 12 interrupts the light beam 18*a*, the container 12 is specifically arranged so that each sensor 16*a–d* irradiates a different section of the flange portion 12*a* of the container and the sensors collectively irradiate approximately 70 percent of the circumference of the flange portion of the container. Sensors 16*a–d* are connected to logic 20 via multiconductors 16*e*. (For clarity, multiconductors 16*e* connecting sensors 16*a* and 16*b* to the logic control 20 are not shown in FIG. 3.)

Figure 4:
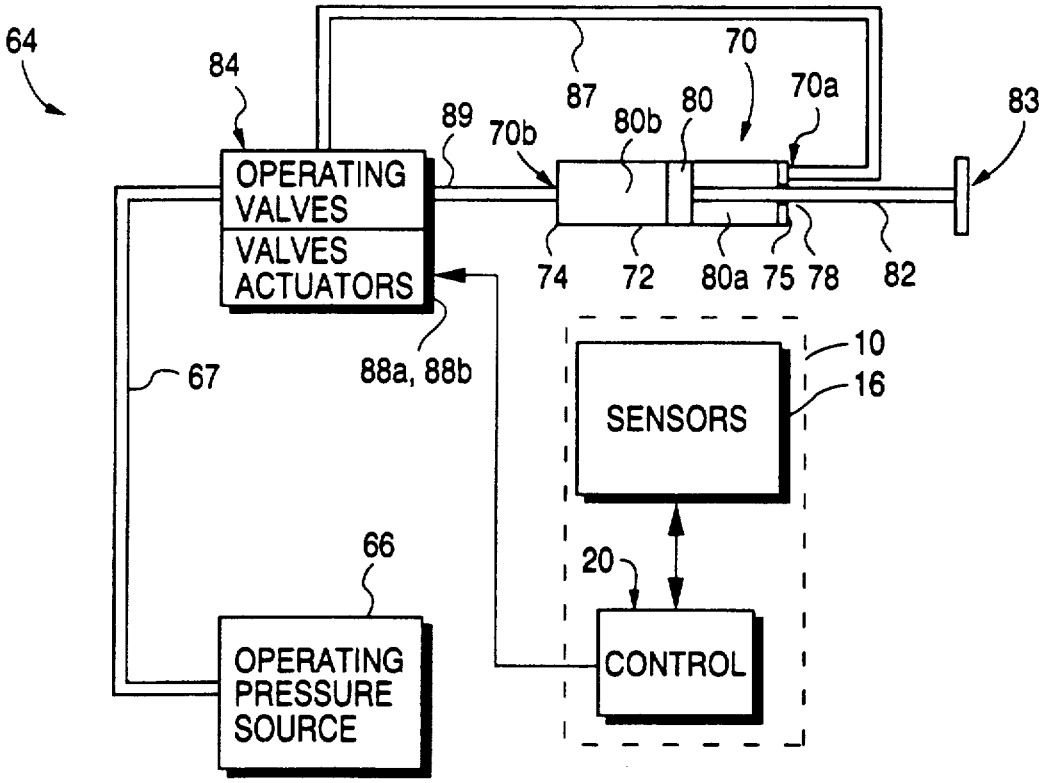
FIG. 4 is an illustration of the defect sensing means and container removal means provided by the invention with a fluid-driven ejection device shown in a cross-section through its center axis and with the remaining portions being represented schematically.

As shown in FIGS. 2 and 4, container removal means 60 comprises a fast-acting, ejection device 64 coupled to a pressurized fluid source 66 via line 67. Ejection device 64 comprises a fluid-driven cylinder 70 and valving means 84 coupled between the pressurized fluid source 66 and the cylinder 70. Device 64 is designed to engage a container positioned at rejection station 4 and remove the container from conveyor 14 upon receiving the rejection signal.

Cylinder 70 has a generally cylindrical sidewall 72, a first end wall 74, a cylinder end cap 75, an orifice 78 formed in cylinder end cap 75, and a piston head 80 carried within the cylinder 70 that is connected to a rod 82 which extends externally of the cylinder through orifice 78. Piston head 80 defines within the cylinder 70 first and second chambers 80*a*, 80*b*, respectively, and pressurized fluid is admitted into first and second chambers 80*a*, 80*b* through retract port 70*a* and extend port 70*b*, respectively. Rod 82 is provided with a pusher 83 attached to its external end for engaging an unacceptable container and knocking it from the conveyor 14.

Valving means 84 comprises first and second valves 85, 86 (FIG. 2) coupled to valve actuating means defined by first and second solenoids 88*a*, 88*b*, respectively. Each valve 85 and 86 is movable between an open and a closed position. First valve 85 is adapted to admit pressurized fluid to and from first chamber 80*a* of cylinder 70 through line 87 and the second valve 86 is adapted to admit pressurized fluid to and from the second chamber 80*b* of the cylinder through line 89. First valve 85 is normally in the open position and the second valve 86 is normally in the closed position.

First valve 85 admits pressurized fluid to the first chamber 80*a* of the cylinder 70 so that the pressurized fluid bears against piston head 80 securing the piston head adjacent first end wall 74 and the rod 82 in the retracted position within the cylinder 70. Thus, for convenience, valve 85 is referred to as the "retract" valve and valve 86 is referred to as the "extend" valve. Upon receiving the rejection signal from defect sensing means 10, solenoid 88*a* closes the retract valve 85 and solenoid 88*b* opens the extend valve 86 to admit pressurized fluid into second chamber 80*b* of the cylinder to bear against the piston head 80 driving the piston head and the rod 82 toward the cylinder end cap 75 of the cylinder to an extended position where piston rod 82 and pusher 83 engage and discharge the unacceptable container from the conveyor, as shown in phantom lines in FIG. 2. Immediately thereafter, solenoid 88*a* quickly reopens the retract valve 85 and solenoid 88*b* quickly closes the extend valve 86 to readmit pressurized fluid into the first chamber 80*a* of cylinder 70 to bear against piston head 80 driving the piston head and the rod back toward the first end wall 74 to the retracted position ready for subsequent operation.

Defect sensing means 10 is operable to track a container that has been designated as unacceptable after the container leaves the inspection station utilizing conventional means such as an internal timing mechanism or the like, and initiates the rejection sequence by activating the solenoids 88*a*, 88*b* to actuate the valves 85, 86. The rejection signal generated by the defect sensing means 10 preferably comprises electric pulses as short as 3.5 milliseconds directed to the solenoids 88*a*, 88*b* to effect the rapid opening and closing of valves 85, 86.

Air cylinder 70 and the valving means 84 are constructed of lightweight material and have enlarged air flow openings to allow increased operating speeds that provide a reject stroke of piston rod 82 that knocks only unacceptable containers from the conveying means 14, even if acceptable containers are in contact with the unacceptable container. The increased operating speed of can removal means 60 allows the system of this invention to operate in conjunction with a conveying means moving at rates up to 550 feet per minute.

Figure 5:
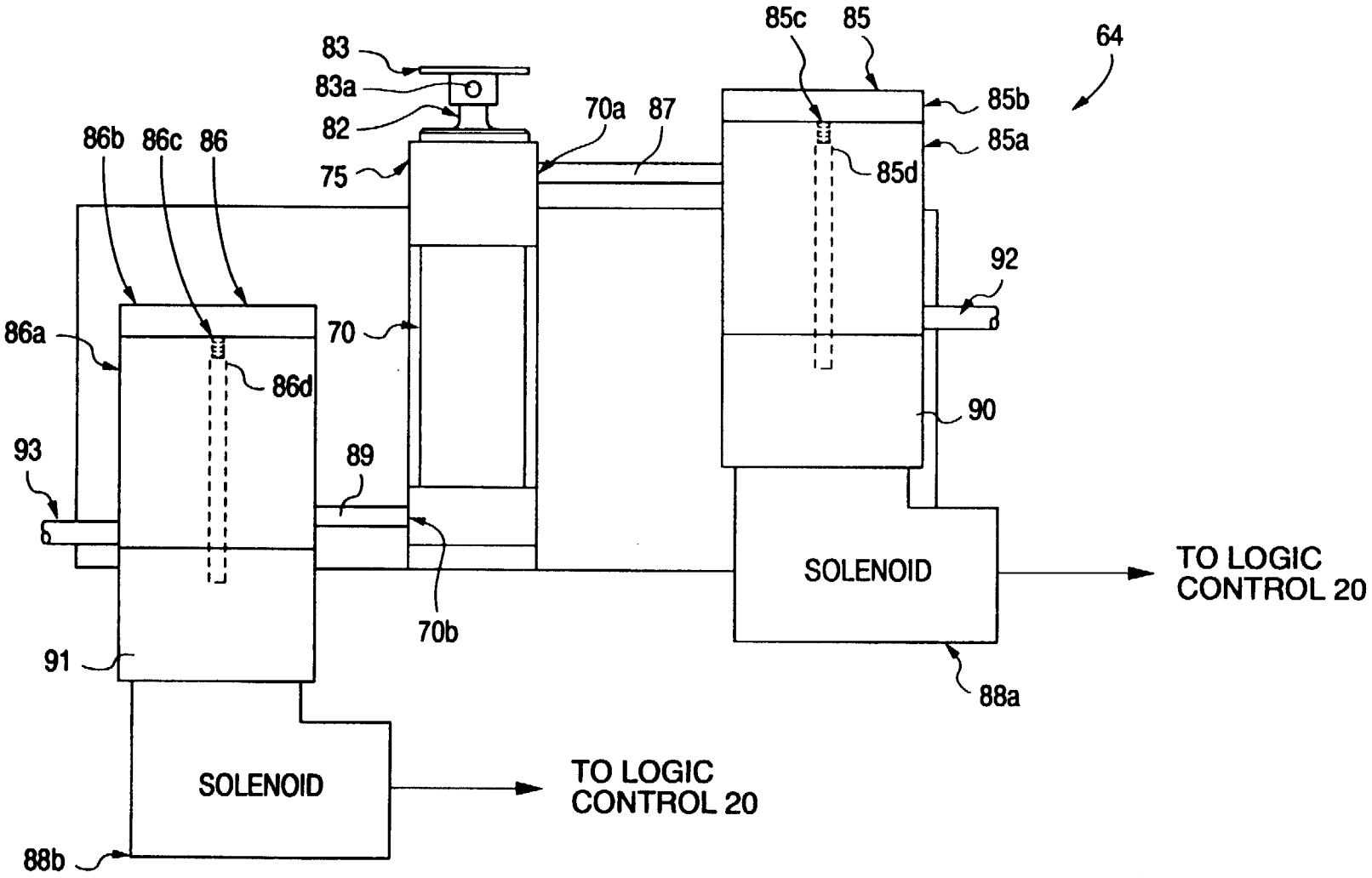
FIG. 5 is an enlarged plan view of the ejection device provided by the invention.

Referring now to FIG. 5, ejection device 64 is shown comprising cylinder 70 coupled to first and second valves 85, 86, which in turn are coupled to solenoids 88*a* and 88*b*, respectively, which in turn are coupled to pilots 90, 91, respectively, all of which are preferably mounted on a support bracket 100 by conventional fastening or securing means. Valves 85 and 86 are preferably connected to the operating pressure source 66 (FIG. 2) by conduits 92, 93 respectively. Piston rod 82 is attached at its internal end to piston head 80 (FIG. 4) and at its external end to pusher 83 by a roll pin 83*a*.

Retract valve 85 is shown in more detail at the right portion of FIG. 5 comprising a valve body 85*a*, a cap 85*b*, a spring 85*c* and a spool 85*d*. Retract valve 85 is coupled to pilot 90 which in turn is coupled to solenoid 88*a*. Retract valve 85 is biased in the open position to admit pressurized fluid to the first chamber 80*a* of the cylinder 70 to maintain the piston 80 in the retracted position to allow acceptable containers to pass through the rejection zone 4 unobstructed. Valves 85 and 86 are similar in construction except that retract valve 85 is configured biased in an open position and extend valve 86 is configured biased in a closed position.

Extend valve 86 comprises a valve body 86*a*, a cap 86*b*, a spring 86*c* and a spool 86*d*. Extend valve 86 is coupled to pilot 91 which in turn is coupled to solenoid 88*b*. However, whereas retract valve 85 is biased in the open position, extend valve 86 is specially constructed in that its valve body 86*a* is oriented 180 degrees in relation to the valve body 85*a* of the retract valve 85. Thus, retract valve 85 is biased in the open position to maintain the piston rod 82 and pusher 83 in the retracted position.

To construct valves 85, 86, one begins with valve bodies 85*a*, 86*a* and couples thereto springs and spools in the end opposite the end to be coupled to the pilot. As indicated above, however, valve body 85*a* of the retract valve is oriented 180 degrees in relation to valve body 86*a* of the extend valve. The solenoids 88*a*, 88*b* and pilots 90, 91 are then coupled to the opposite ends of valve bodies 85*a*, 86*a*, thus resulting in retract valve 85 being biased oppositely as to extend valve 86.

Each valve 85 and 86 has a high flow area ($C_v$=0.18 or greater) and a low-voltage (12 volt), high-watt (17 watt) solenoid 88*a* and 88*b*, respectively, tuned to the mass of the valve operator. The solenoids are pilotassisted to achieve faster speeds by pilots 90 and 91. Four-way valves are preferably used because of their higher $C_v$ and minimum valve spool displacement. Further, two valves 85 and 86 are preferably used so their on/off or activation times can be independently controlled by logic control 20. Independent control allows pressure to build in the opposite chamber or mode (extend or retract) within cylinder 70 before holding pressure is released in the current mode, thereby minimizing the capacitive effect of the piping volume between the cylinder 70 and the valves 85 and 86. The valves are preferably close coupled to the cylinder 70 to even further reduce the capacitive volume.

Figure 6:
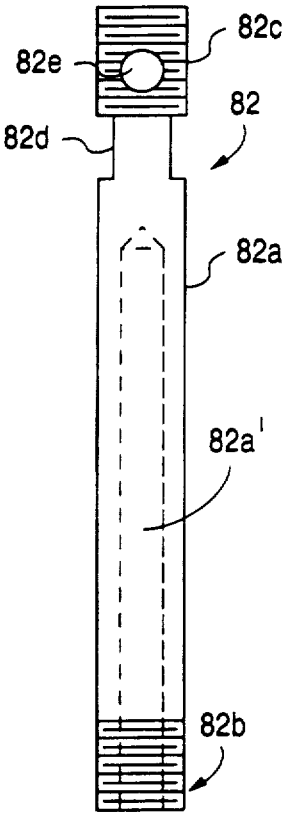
FIG. 6 is a side view of a piston rod of the ejection device of FIG. 5.

Shown in FIG. 6 is piston rod 82 comprising a generally cylindrical body 82*a* having a longitudinal bore 82*a'* extending partially therethrough, a first externally threaded portion 82*b* at one end, a second externally threaded portion 82*c* at the opposite end and a thin cylindrical portion 82*d* arranged between the end 82*c* and the body 82*a* of the piston rod. First end 82*b* threadably secures the piston head 80 (FIG. 4) to the piston rod. End 82*b* is of a minimal length to sufficiently secure the piston head to the piston rod. Second end 82*c* is provided with a bore 82*e* to receive the roll pin 83*a* (FIG. 5) which secures the pusher 83 to the piston rod.

Figure 7A:
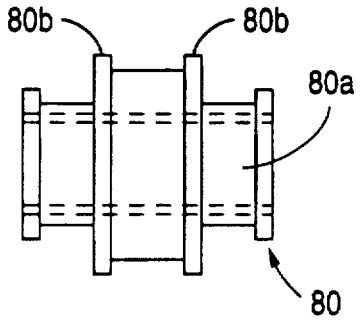
FIG. 7A is a side view of the piston head of the ejection device and FIG. 7B is an end view of the piston head of FIG. 7A.
Figure 7B:
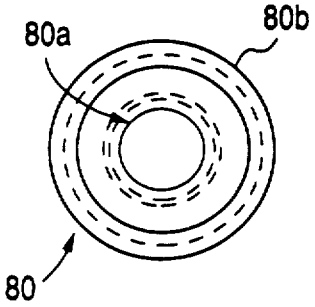

Piston head 80 is shown in FIGS. 7A and 7B having an internally threaded bore 80*a* extending therethrough and flange surface portions 80*b* which contain seals that engage the interior walls of the air cylinder 70. Bore 80*a* receives externally threaded end 82*b* of piston rod 82.

Figure 8A:
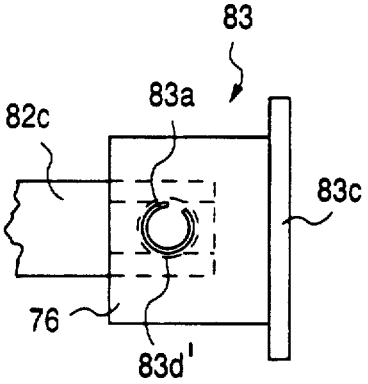
FIG. 8A is a side view of a pusher assembly attached to the piston rod of FIG. 6.
Figure 8B:
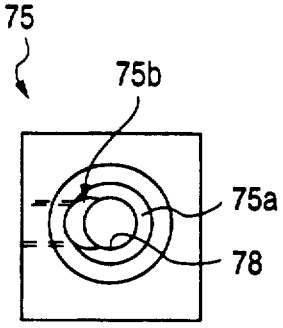
FIG. 8B is an end view of the cylinder end cap of the cylinder.

Shown in FIG. 8A is the pusher 83 arranged on the second end 82*c* of the piston rod and secured thereto by roll pin 83*a*. Pusher 83 comprises a bushing portion 76 and a ram plate portion 83*c* which physically contacts the container and knocks it from the conveyor 14. Bushing portion 76*a* is provided with an orifice 83*a'* through which pin 83*a* extends to secure the pusher 83 to the end 82*c* of the piston rod. Shown in FIG. 8B is cylinder end cap 75 having orifice 78 formed therein through which piston rod 82 extends. (Piston rod 82 is not shown for clarity). Preferably, portion 75*a* that extends within cylinder 70 is milled about one-quarter inch deep from the inside of portion 75*a* to provide an enlarged passage 75*b* to enhance the air flow through the cylinder end cap 75, thereby increasing the cycle stroke speed.

Maximizing the operational speed of the reject device 64 is achieved by minimizing the time and distance of a complete stroke of the air cylinder 70. The piston bore 82*a*; the short threaded end 82*b*, the thin portion 82*d*, the passage 76*e* and the lightweight materials (preferably aluminum) of which the cylinder assembly 70 and its components are constructed, act collectively to reduce the mass of its moving parts and maximize the cycle speed of the system. Also, the cylinder is provided with piston seals at its ends which act as shock absorbers by compressing when engaged by the piston when in either the extended or retracted position and bouncing back to their original form. This action tends to give the piston a "push" in the opposite direction to reach its maximum stroke speed more quickly. The fastest cycle speed of conventional cylinders of which the applicant is aware is about 40 milliseconds. The cycle speed achievable by the air cylinder 70 provided by this invention is about 13 milliseconds.

Further adding to the maximization of the stroke speed of the air cylinder 70 is the placement of the eject mechanism 64 adjacent to the moving stream of parts on conveyor 14 such that the last 30 percent of the cylinder stroke contacts the unacceptable container. This position allows the piston speed to maximize before impacting the part which increases the impact force to rapidly eject the part.

In operation, as the leading edge of a defective container breaks the beam 62*a* of photosensor 62, photosensor 62 sends a signal to the electronic control 20 which then energizes, thereby closing, the solenoid 88*a* of the normally open retract valve 85 allowing the holding pressure in chamber 70*a* the air cylinder 70 to exhaust to atmosphere. As the container passes by the photobeam 62*a*, sensor 62 generates a second signal to the control 20 indicating the trailing edge of the part, thereby initiating the eject cycle. Control 20 then generates the rejection signal energizing, thereby opening, the normally closed extend valve 86 by providing a 4 ms pulse to solenoid 88*b*. This sequence provides a pulse of air to rapidly extend the piston rod 82 and pusher 83 to knock the unacceptable container from the conveyor 14. Before the piston rod reaches full stroke in its path toward end wall 76, the retract valve 85 is already beginning to build pressure in the retract side of the air cylinder 70 (first chamber 80*a*). The retract air pulse reaches maximum pressure when the piston rod 82 has moved to its most extended position and begins to rebound from the piston seal shock absorbers of the cylinder 70. The rebound force plus the retract pressure already building in first chamber 80*a* forces the extend side of the cylinder 70 (second chamber 80*b*) to exhaust rapidly thus reducing the normal time to retract the piston rod 82.

The electronic logic control 20 employed by this invention uses a frequency generator to create discreet 1 millisecond (or faster) electric signal pulses which are directed to solenoids 88*a*, 88*b*. These pulses are counted to provide exact time increments for the sequencing of the solenoids 88*a*, 88*b* coupled to the valves. The voltage to energize the solenoids is higher (24 volts) than a normally rated voltage (12 volts) which increases the operating speed of the valves even more. Due to its increased stroke speed, reject device 64 of this invention is capable of ejecting containers even when the containers are in contact with a few thousandths of an inch of one another.

Placement of the position photosensor 62 must be determined by trial to allow the cylinder 70 to strike the moving container to provide an eject path that will not disturb adjacent parts and to compensate for the momentum of the part moving on the conveyor. This placement is illustrated by dimension "D" in FIG. 2.

The preferred embodiment of this invention also presents a method for inspecting containers and detecting and rejecting defective containers from a manufacturing line. The method is generally carried out by determining a desired structural integrity for the flange or neck portion of the container and a minimum acceptable height, presenting the containers to an inspection station, sensing the structural integrity of the flange and the height of the container, determining if the sensed structural integrity of the flange and sensed height are acceptable, and if the sensed values are not acceptable, removing the container.

The sensing of the structural integrity of the flange of the container includes irradiating the circumference of the flange portion 12*a* of the container with infrared light, receiving the infrared radiation reflected from the flange portion, and determining the structural integrity by the quantum of radiation received from the flange portion. Determining the height of the container is similarly carried out by irradiating the circumference of the flange portion of the container at different heights, and receiving the quantum of radiation reflected and received from the flange portion of the container.

Rejecting unacceptable containers includes generating a rejection signal if a predetermined quantum of the radiation is not reflected and received from the flange portion.

The desired structural integrity and the desired height of the container are necessarily determined prior to operation and may be stored in a storage means 40 included with the control 20, or programmed directly into the logic control 20 if a storage means is not employed.

This invention thus provides a defect sensing means coupled to a container removal means. The defect sensing means utilizes infrared reflective sensors to inspect the flange and verify the height of containers presented at the inspection station. The container is determined to be positioned correctly for inspection when it interrupts a first position photoelectric detector, and at that instant, the container is inspected by the plurality of reflective infrared sensors circumferentially arranged about the inspection zone. The reflective sensors utilize bifurcated fiber optics to direct a narrow beam of infrared light at the flange portion of the container and can be arranged to verify the height of the can, as well as radiating infrared light at the flange of the container to determine whether the structural integrity of the flange is acceptable. If a defect or otherwise unacceptable deformation exists in the flange, one of the plurality of reflective sensors will receive insufficient reflected infrared light and the container will be identified as unacceptable.

Once a container is identified as unacceptable, the electronic logic control then tracks the unacceptable container as it is transported by the conveyor 14 until the container reaches the rejection station. As the unacceptable container enters the rejection station, a second position photoelectric detector senses the presence of the container and the reject cycle begins.

Upon receiving the container-present signal, the logic control 20 directs a rejection signal to the can removal means which includes fast-acting solenoid air valves 84. Upon receiving the rejection signal, the solenoid valves 85, 86 shift quickly causing air cylinder 70 to extend very rapidly knocking the unacceptable container from the conveyor. The special assembly of the solenoid air valves coupled to the rejection cylinder provides a rejection stroke that removes only bad or unacceptable containers from the conveyor, even if acceptable containers are touching or in contact therewith.

In an alternative application, sensors 16 can also be adapted to inspect the coating of a container and if the coating is defective, insufficient light will be reflected back to the originating sensor and the container will thus be identified as defective and unacceptable.

While the present invention has been described with preferred embodiments, it is to be understood that modifications and variations may be resorted to, without departing from the spirit and scope of this invention, as those ordinarily skilled in the art will readily understand. Such modifications and variations are considered to be within the scope of the appended claims and the invention is to be limited only by the scope of the claims and their equivalents.

I claim:

1. A system for inspecting containers being transported by conveying means through an inspection station and for removing unacceptable containers at a rejection station, each container having a body, a pair of opposing ends, one of which is open, and a flange portion adjacent the open end, said system comprising:

defect sensing means arranged adjacent the inspection station for inspecting the flange portion of the container and, if the flange portion is unacceptable, for generating a rejection signal, said defect sensing means including logic control means and one or more reflective infrared sensors; and container removal means arranged adjacent the rejection station for removing unacceptable containers from the conveying means, said container removal means comprising a pneumatic rejection device coupled to a pressurized fluid source for knocking unacceptable containers from the conveying means, said reflective infrared sensors being circumferentially arranged at vary heights about the inspection station for irradiating the flange portion of the container with narrow beams of infrared light and for receiving radiation reflected therefrom, the acceptability of the flange portion being determined by the quantum of radiation received by said sensors, said reflective infrared sensors being arranged at vary heights so as to sense the height of the container, the height of the container being determined by the signals from the particular sensors whose infrared light is not reflected and thus not received by said sensors.

2. The system as in claim 1 wherein said defect sensing means further includes a first container position sensing means arranged adjacent to the inspection station for indicating when a container is positioned at the inspection station.

3. The system as in claim 2 further including a second container position sensing means arranged adjacent to the rejection station for indicating when a container is positioned at the rejection station.

4. The system as in claim 1 wherein each of said reflective infrared sensors is positioned to direct infrared light at a different section of the flange portion of the container and receive infrared light reflected therefrom and to generate a corresponding inspection signal.

5. The system as in claim 1 wherein each of said reflective infrared sensors includes a plurality of bifurcated optics means.

6. The system as in claim 1 wherein said pneumatic rejection device comprises:

a cylinder having a generally cylindrical side wall, a first end wall, a cylinder end cap opposite the first end wall and an orifice formed in the cylinder end cap, said cylinder carrying at least one piston head therein defining a first and second chamber within said cylinder;

a rod connected to said piston head and extending externally of the cylinder through said orifice formed in the cylinder end cap; and valving means coupled to a pressurized fluid source and to the cylinder, said logic control means being adapted to track an unacceptable container after the container leaves the inspection station and generate the rejection signal initiating a rejection sequence, the rejection signal activating the valving means to admit pressurized fluid to and from said cylinder to drive the rod between a first position where said rod is contracted within the cylinder and does not interfere with the conveyance of containers through the rejection station and a second position where the rod is extended and removes the unacceptable container from the conveying means.

7. The system as in claim 6 wherein said valving means comprises a first and a second solenoid valve coupled to a valve actuating means, each valve being independently movable between an open and a closed position, the first valve being independently operable to admit pressurized fluid to and from the first chamber of said cylinder, the second valve being independently operable to admit pressurized fluid to and from the second chamber of said cylinder, said first valve normally being positioned in the open position and the second valve normally being positioned in the closed position, thereby admitting pressurized fluid to the first chamber of said cylinder to secure the piston head and the rod in the retracted position, said valve actuating means being operable upon receiving the rejection signal to close the first valve and open the second valve to admit pressurized fluid into said second chamber, said pressurized fluid driving the piston head and the rod to the extended position where the piston rod engages and discharges the defective container from the conveying means, and said valve actuating means being operable to independently reopen the first valve and close the second valve to admit pressurized fluid to the first chamber to drive the piston head and the rod to the retracted position ready for subsequent operation.

8. The system as in claim 7 wherein said rejection signal comprises electric pulses as short as 3.5 milliseconds.

9. The system as in claim 1 wherein the conveying means is capable of transporting the containers through the inspection station at rates up to 550 feed per minute.

10. A system for inspecting metallic containers and detecting and rejecting defective containers, each said container having a generally cylindrical body, a pair of opposing ends, one of which is open and the other of which is closed, and an upper flange portion adjacent the open end, said system comprising:

means for conveying the containers in an upright position through an inspection station and therefrom to a rejection station;

a first photoelectric detector positioned adjacent to the inspection station for generating a first container present signal indicating when a container is positioned at the inspection station;

a plurality of reflective infrared sensors arranged circumferentially about the inspection station for inspecting the flange portion of the containers and generating a corresponding first inspection signal and for determining the height of the container and generating a corresponding second inspection signal, each of said reflective infrared sensors being adapted to inspect a different section of the flange portion;

a second photoelectric detector arranged adjacent to the rejection station for generating a second container present signal indicating when a container is positioned at the rejection station;

a fluid-driven container removal mechanism arranged adjacent to the rejection station for engaging and removing defective containers from the conveying means; and electronic control means coupled to the first and second photoelectric detectors, the array of reflective infrared sensors and the container removal mechanism, said control means being adapted to receive the first inspection signal and determine whether the flange portion is acceptable and generate a rejection signal if the flange portion is not acceptable, said control means being further adapted to receive the second inspection signal and determine whether the can is of acceptable height and generate a rejection signal if the height of the container is not acceptable.

11. An apparatus for inspecting metallic cans being transported by their base portions through an inspection zone by a conveying means, each can having a base portion at one end and an open portion at the other end, said apparatus comprising:

can inspection means positioned with respect to the conveyor means at the inspection zone for inspecting each can as it is carried through the inspection zone comprising a plurality of reflective sensor means, each of said reflective sensor means being positioned to direct a plurality of narrow beams of infrared light at a different section of the open portion and to receive only the infrared light reflected from each said different section, said can inspection means being further adapted to determine from the radiation received by said plurality of reflective sensor means cans having unacceptable open portions.

12. The apparatus of claim 11 wherein said plurality of reflective sensors are positioned about the inspection station in a circumferential array.

13. The apparatus of claim 11 further comprising means, operable by said can inspection means, for removing unacceptable can from the conveying means.

14. An apparatus for inspecting metallic cans being transported by their base portions through an inspection zone by a conveying means, each can having a base portion at one end and an open portion at the other end, said apparatus comprising:

a plurality of reflective flange sensor means, each of said reflective sensor means being positioned to irradiate a different section of the open portion and to receive the radiation reflected from each said different section, said can inspection means being adapted to determine, from the radiation received by said plurality of reflective sensor means, cans having unacceptable open portions; and a can height photoelectric sensor for determining whether said can is of a predetermined minimum acceptable height and if the can is not of the minimum height, designating the can as unacceptable.

15. An apparatus for inspecting metallic cans being transported by their base portions through an inspection zone by a conveying means, each can having a base portion at one end and an open portion at the other end, said apparatus comprising a plurality of reflective sensor means, each of said reflective sensor means being positioned to irradiate a different section of the open portion with narrow beams of infrared light and to receive the radiation reflected from each said different section and one or more of said reflective sensor means being positioned to determine the height of the can, said can inspection means being further adapted to determine from the radiation received by said plurality of reflective sensor means cans having unacceptable open portions.

16. A method for inspecting containers having at least one open end and a flange portion adjacent said open end, said method comprising the steps of:

presenting the container to an inspection station;

sensing the structural integrity of the flange portion of the container and the height of the container at the inspection station by irradiating the circumference of the flange portion of the container with infrared light at ranging heights and receiving radiation reflected therefrom; and generating a rejection signal if the structural integrity of the flange portion or the height of the container is unacceptable, the acceptability of the structural integrity of the flange portion of the container and the height of the container being determined by the quantum of radiation reflected and received from the flange portion.

17. The method as in claim 16 further including the step of presenting each container to a removal station after each container is presented to said inspection station and removing the container at the removal station if the sensed structural integrity or the sensed height of the container is unacceptable.

18. The method of claim 17 wherein said removing step includes tracking the unacceptable container and activating removal means to remove the defective container when the deflective container is positioned at the removal station.

19. The method of claim 16 wherein said step of sensing the height of the container is carried out by at least one infrared reflective photosensor arranged at a different height adjacent to the inspection station, said photosensor including bifurcated optics to direct a beam of infrared light across the open end of the container to verify the height of the container.

20. The method of claim 16 wherein said step of presenting said containers to the inspection station comprises sequentially transporting a plurality of said containers in an upright position through the inspection station at speeds up to 550 feet per minute.

21. The method as in claim 16 wherein said step of sensing the structural integrity of the flange portion comprises irradiating different circumferential sections of the flange portion with a plurality of infrared reflective photosensors, each of which is adapted to direct infrared light at a different circumferential flange section and receive infrared light reflected from each different circumferential section.

22. The method as in claim 16 further including the steps of:

projecting a first light beam from a first electro-optical light conducting unit;

projecting a second light beam from a second electro-optical light-conducting unit;

receiving the first light beam by a first electro-optical photosensitive receiving unit;

receiving the second light beam by a second electro-optical photosensitive receiving unit; and generating a first container present signal to initiate the sensing of the structural integrity of the flange portion of the container and the height of the container when a container being presented to the inspection station interrupts said first light beam; and generating a second container present signal to initiate a rejection sequence when a defective container presented to a rejection station interrupts said second light beam.

23. A method for inspecting, at an inspection station, metallic containers being transported by a conveyor and for rejecting therefrom, at a rejection station, unacceptable containers wherein each container has a generally cylindrical body, an open end, a closed end and a neck portion adjacent to the open end, said method comprising the steps of:

sensing when a container is positioned at the inspection station utilizing a first photoelectric eye;

inspecting the structural integrity of the neck portion of the container when the container is positioned at the inspection station utilizing an array of reflective infrared sensors circumferentially arranged about the inspection station;

sensing the height of the container when the container is positioned at the inspection station by arranging said reflective infrared sensors at varying heights circumferentially about the inspection station;

determining whether the sensed structural integrity of the neck portion and the sensed height are acceptable and, if either the sensed structural integrity or the sensed height is unacceptable, designating the container as unacceptable;

tracking the unacceptable container after it leaves the inspection station and determining when the defective container is positioned at the rejection station utilizing a second photoelectric eye; and discharging the unacceptable container from the conveyor utilizing a fluid-driven rejection device.

24. A defect sensing device for inspecting the structural integrity of containers presented to an inspection zone, each container having a generally cylindrical body, at least one open end and a flange adjacent to the open end, said device comprising:

reflective sensing means positioned adjacent to the inspection zone, said sensing means being adapted for uniformly irradiating the circumference of the flange of the container with infrared light from varying heights, for receiving infrared light reflected from the flange, and for generating an inspection signal corresponding to the quantum of infrared light received; and electronic logic means coupled to said sensing means, said electronic logic means determining whether the flange and the height of the container are acceptable by receiving the inspection signal and determining the quantum of infrared light received by the sensing means, and if a predetermined quantum of infrared light is not received by the sensing means, generating a rejection output thereby indicating an unacceptable container.

25. A rejection device arranged adjacent conveying means at a rejection station for removing containers from the conveying means, said rejection device comprising:

a pneumatic cylinder having a generally cylindrical side wall, a first end wall, a cylinder end cap opposite the first end wall and an orifice formed in the cylinder end cap, said cylinder carrying a piston head therein defining a first and second chamber within said cylinder;

a piston rod connected to said piston head and extending externally of the cylinder through said orifice formed in the cylinder end cap; and solenoid valving means coupled between a pressurized fluid source and the cylinder, said valving means being operable to admit pressurized fluid to and from said cylinder to drive the piston rod between a first position where the piston rod is contracted within the cylinder and a second position where the piston rod is extended to engage and remove a container from the conveying means, said solenoid valving means comprising a first and a second pneumatic four-way valve, each said valve being operable independently of the other and coupled to a first and second solenoid actuator, respectively, each solenoid actuator being coupled to a separate pilot assembly, each valve being movable between an open and a closed position, the first valve being operable to admit pressurized fluid to and from the first chamber of said cylinder, the second valve being operable to admit pressurized fluid to and from the second chamber of said cylinder, said first valve being positioned normally in the open position and the second valve being positioned normally in the closed position, thereby admitting pressurized fluid to the first chamber of said cylinder wherein said pressurized fluid bears against the piston head and secures the piston head and the piston rod in the retracted position against the first end wall, said first solenoid actuator being operable to close the first valve and said second solenoid actuator being independently operable to open the second valve upon command to admit pressurized fluid into the second chamber to bear against the piston head driving the piston head and the piston rod toward the cylinder end cap to the extended position where the piston rod engages and discharges only the defective container from the conveying means, said first solenoic actuator further being independently operable to reopen the first valve and said second solenoic actuator being independently operable to close the second valve to admit pressurized fluid into the first chamber to bear against the piston head driving the piston head and the piston rod back to the retracted position ready for subsequent operation, said first and second valves being operable independent of the other so that when the piston head is being driven toward the first end wall of the cylinder, pressurized fluid is being admitted into the first chamber of the cylinder before the pressurized fluid in the second chamber is entirely released, and when the piston head is being driven toward the cylinder end cap of the cylinder, pressurized fluid is being admitted into the second chamber of the cylinder before the pressurized fluid in the first chamber is entirely released, thereby allowing the piston head to change direction rapidly.

26. The rejection device as in claim 25 wherein said cylinder, piston head and valves are constructed of lightweight material, and wherein said piston rod has an internal bore extending partially longitudinally therethrough.

27. The rejection device as in claim 26 wherein said each said valve has a flow area of at least 0.18 and wherein each said solenoid actuator has a low-voltage, high-wattage capacity.

28. The rejection device as in claim 25 wherein each valve comprises:

a valve body having an internal bore extending partially longitudinally therethrough;

a cap coupled to the valve body;

a spring coupling said cap to said valve body; and a spool received by the internal bore of said valve body and connected to said cap, said spool being driven by the solenoid actuator, and wherein the valve body of said first valve is oriented 180 degrees in relation to the valve body of said second valve so that the first valve is biased in the open position and the second valve is biased in the closed position.

* * * * *